United States Patent [19]

Nahlovsky et al.

[11] Patent Number: 4,985,094

[45] Date of Patent: Jan. 15, 1991

[54] THERMOPLASTIC CASTABLE COMPOSITE ROCKET PROPELLANT

[75] Inventors: Boris D. Nahlovsky; Gilbert A. Zimmerman, both of Sacramento, Calif.

[73] Assignee: The United States of America as represented by the Secretary of the Air Force, Washington, D.C.

[21] Appl. No.: 489,562

[22] Filed: Mar. 7, 1990

[51] Int. Cl.[5] ..... C06B 45/10

[52] U.S. Cl. ..... 149/19.92; 149/19.9; 149/42; 149/76.109.6

[58] Field of Search ..... 149/19.9, 76, 42, 19.92, 149/109.6

[56] References Cited

U.S. PATENT DOCUMENTS 4,361,526 11/1982 Allen ..... 149/19.9
4,597,924 7/1986 Allen et al. ..... 149/19.4
4,764,316 8/1988 Brown et al. ..... 149/19.92
4,806,613 2/1989 Wardle ..... 528/59
4,889,571 12/1989 Willer et al. ..... 179/19.9

*Primary Examiner*—Stephen J. Lechert, Jr.
*Attorney, Agent, or Firm*—Charles E. Bricker; Donald J. Singer

[57] ABSTRACT

A castable, thermoplastic composite rocket propellant comprising about 3 to 10 wt % of a thermoplastic elastomer, about 3 to 20 wt % of a plasticizer, balance energetic particulates is provided.

Also provided is a process for producing a thermoplastic composite rocket propellant which comprises melt blending a thermoplastic elastomer and about 100 to 300 phr (parts by weight per 100 parts by weight of rubber (elastomer)) plasticizer, adding energetic particulates to the melt, with mixing, and casting the mixture in a suitable mold.

8 Claims, No Drawings

THERMOPLASTIC CASTABLE COMPOSITE ROCKET PROPELLANT

RIGHTS OF THE GOVERNMENT

The invention described herein may be manufactured and used by or for the Government of the United States for all governmental purposes without the payment of any royalty.

BACKGROUND OF THE INVENTION

The present invention relates to solid propellant grains or the like and more particularly to a process for preparing propellant grains comprising thermoplastic binders and suspended solid particulates.

Conventional solid composite propellants have binders which utilize cross-linked elastomers in which prepolymers are cross-linked by chemical curing agents. As outlined in U.S. Pat. No. 4,361,526, there are important disadvantages to cross-linked elastomers. Cross-linked elastomers must be cast within a short time after addition of the curing agent, which time period is known as the 'pot life'. Disposal of a cast cross-linked propellant composition is difficult, except by burning, which poses environmental problems.

As an alternative to cross-linked elastomer binders, U.S. Pat. No. 4,361,526 proposes to use a thermoplastic elastomeric binder which is a block copolymer of a diene and styrene, the styrene blocks providing a meltable crystalline structure and the diene blocks imparting rubbery or elastomeric properties to the copolymer. In order to prepare a propellant composition using the copolymer, the copolymer is dissolved in an organic solvent, such as toluene, and the solids and other propellant ingredients are added. The solvent is then evaporated, leaving a rubbery solid which may be divided into pellets suitable for casting or other processing.

A disadvantage of formulating a propellant using a thermoplastic elastomeric binder which must be dissolved in a solvent is that the propellant grain cannot be cast in a conventional manner, e.g., into a rocket motor casing. Further, solvent-based processing presents problems with respect to removal and recovery of the solvent. Organic solvents, such as toluene., present certain hazards to the immediate work area and to the larger environment, necessitating various precautions to be taken with regard to processing such propellant formulations.

It has also been proposed to produce thermoplastic elastomeric propellants in which the solid particulates and thermoplastic elastomer are fused in a high-shear mixer and the fused mixture poured or extruded into a casing or mold. There are important disadvantages with such techniques. Because of the high-solids loading of propellant formulations, viscosities tend to be quite high, making mixing difficult, and, in many cases, impossible on a large scale. Localized overheating in high-shear apparatus can cause ignition and catastrophic combustion of these high-energy formulations.

As an alternative to high-shear mixing and/or extrusion, U.S. Pat. No. 4,764,316 proposes to dry blend thermoplastic elastomer particles and energetic particles, pack the blended particles into a mold or casing, then fuse the particulates and thermoplastic elastomer together. A disadvantage of this method is the possibility of voids in the fused propellant.

There exists a need for improved processes for producing propellant grains with thermoplastic elastomer binders.

Accordingly, it is an object of the present invention to provide a castable, thermoplastic composite rocket propellant.

It is another object of this invention to provide a process for producing a thermoplastic composite rocket propellant.

Other objects and advantages of the present invention will become apparent to those persons skilled in the art from a reading of the following description of the invention.

SUMMARY OF THE INVENTION

In accordance with the present invention, there is provided a castable, thermoplastic composite rocket propellant comprising about 3 to 10 wt % of a thermoplastic elastomer, about 3 to 20 wt % of a plasticizer, balance energetic particulates.

Also provided is a process for producing a thermoplastic composite rocket propellant which comprises melt blending a thermoplastic elastomer and about 100 to 300 phr (parts by weight per 100 parts by weight of rubber (elastomer)) plasticizer, adding energetic particulates to the melt, with mixing, and casting the mixture in a suitable mold.

DETAILED DESCRIPTION OF THE INVENTION

A wide variety of thermoplastic elastomers may be used in the present invention, provided they have suitable properties, including the following: melting temperature of about 50° to 125° C., preferably about 75° to 125° C.; viscosity at or below 125° C. of 400 Poise or less; stable at 125° C. for at least 12 hours, preferably about 20 hours at the melting temperature; a glass transition temperature of −4° C. or below, preferably −20° C. or below, more preferably −40° C. or below; and compatibility with the energetic particles.

Suitable thermoplastic elastomers include styrene-diene block copolymers, such a styrene-butadiene, styrene-isoprene, styrene-ethylene/butylene block copolymers having star or radial, triblock (e.g., styrene-butadiene-styrene), multiblock or graft configurations, nonstyrenic block copolymers such as polyester-polyether, polyamide-polyether or segmented polyurethanes, ionomers, polyolefin thermoplastic elastomers, 1,2-syndiotactic polybutadiene and ethylene-vinyl acetate/ethylene-acrylic acid copolymers.

Particularly suitable for use in the present invention are the triblock and star-configured (radial) styrene-butadiene block copolymers. The polystyrene and polybutadiene segments of these polymers are thermodynamically incompatible and form separate microdomains, both in the elastomeric state and in the melt. Since both blocks are separated into two phases, two glass transitions are observed, one for each phase. The block copolymer is elastomeric in the region between the two glass transition temperatures. The triblock copolymers are preferable to radial copolymers because they require less plasticizer to achieve the desired low melt viscosity. This is because the molecular weight of radial copolymers is about double that of the triblock copolymers. In general, for use in the present invention molecular weights in the approximate range of 50,000 to 250,000 are desired.

The styrene-butadiene block copolymers are available commercially from a number of manufacturers, in a variety of molecular weights and relative concentrations of the styrene/butadiene segments. Examples of commercial materials are the radial copolymer available from Cosden Oil and Chemical Co., Dallas, Tex., under the tradename Finaprene and the triblock copolymer available from Shell Oil Co., Houston, Tex., under the tradename Kraton.

Plasticizers for use in the present invention should be compatible with the thermoplastic elastomer (TPE) and the energetic particulates, should have a low pour point, low viscosity and low volatility with good thermal stability at 125° C. The styrenic TPEs may be plasticized with nonpolar plasticizers such as mineral oils, while the nonstyrenic TPEs may be plasticized with polar plasticizers. Suitable nonpolar plasticizers include Tufflo 6016, a paraffinic oil available from Lyondell Petrochemical Co., Houston, Tex., and Oronite, a polyisobutene, available from Amoco Chemicals Corp., Chicago, Ill. The quantity of plasticizer employed with the TPE is sufficient to provide a $P_l/P_o$ (Plasticizer/-Polymer) ratio of about 1:1 to 3:1, or about 100 to 300 phr (parts by weight per 100 parts by weight of rubber or elastomer).

Energetic particulates are selected from energetic materials that are commonly used in propellant formulations. Particulate aluminum, beryllium or boron are common fuel materials. Common oxidizers include ammonium perchlorate (AP), potassium perchlorate (KP),ammonium nitrate (AN), cyclotrimethylene trinitramine (RDX), and cyclotetramethylene tetranitramine (HMX), as well as mixtures thereof. In general, the propellant formulations of the present invention comprise about 80 to 92 wt % energetic solids, with the balance of the grain consisting essentially of the binder system.

The propellant formulation optionally includes minor amounts of additional components, such as processing aids, burn rate modifiers (up to about 1 wt %), bonding agents (about 0.3 to 0.5 wt %), such as aminopropyl triethoxysilane (available from Union Carbide under the tradename A-1100) or neoalky 1 tri(N-ethylamino ethylamino) titanate, etc. which are known in the art. The formulation may further comprise up to about 3 wt % of a resin or polymer modifier such as Endex 160, an alpha-methylstyrene resin, available from Hercules, Inc., which acts to sharpen the melting point of the binder system of TPE and plasticizer.

The thermoplastic elastomer and the plasticizer are mixed, using a high-shear mixer, at a temperature above the melting temperature of the polymer. The solids and optional components of the propellant formulation are then mixed into the melt using a low-shear mixer. Because of the relatively low viscosities of the molten polymer/plasticizer mixture, no solvents are required for blending or other processing, such as casting or extrusion.

An example of a propellant formulation embodying the present invention is as follows with the percentages given by weight:

| | |
|---|---|
| Finaprene 416 (binder) | 3.28 |
| Tufflo 6016 (plasticizer) | 9.01 |
| Endex 160 (polymer modifier) | 1.31 |
| Ammonium Perchlorate (oxidizer) | 68.0 |
| Aluminum (fuel) | 18.0 |
| A-1100 (bonding agent) | 0.4 |

The binder consisting of the Finaprene 416, Tufflo 6016 and Endex 160 was melted and blended in an internal mixer at a suitable temperature. The ammonium perchlorate and aluminum were then mixed into the binder in increments. The A-1100 bonding agent was added with mixing, and the homogeneous mixture cast at 125° C. into a rocket motor case and allowed to cool.

The resulting propellant had a tensile strength of 104 psi, elongation at break of 26%, with a modulus $E_0$ of 555 psi at 25° C. The onset of softening occurred at 58° C. (by TMA); creep was minimal below 40° C. End of mix viscosity was 57 kpoise at 125° C. The propellant had a burn rate of 0.60 in/sec at 1000 psi chamber pressure and a burn rate exponent of 0.48.

Such a propellant has 86 wt % solids for high performance, yet the binder-plasticizer combination is sufficiently fluid for processing.

Various modifications may be made to the invention as described without departing from the spirit of the invention or the scope of the appended claims.

We claim:

1. A process for producing a thermoplastic composite rocket propellant which comprises melt blending about 3 to 10 wt % of a styrene-diene block copolymer, about 3 to 20 wt % of a plasticizer, up to about 3 wt % of a resin modifier, up to about 1 wt % of a ballistic modifier and 0.3 to 0.5 wt % of a bonding agent, wherein the plasticizer:copolymer ratio is about 1:1 to 3:1, adding about 70 to 94 wt % energetic particulates to the melt, with mixing, and casting the mixture in a suitable mold.

2. The process of claim 1 wherein said plasticizer is a paraffinic oil.

3. The process of claim 2 wherein said energetic particulates are ammonium perchlorate.

4. The process of claim 2 wherein said energetic particulates are ammonium perchlorate and aluminum powder.

5. The process of claim 2 wherein said thermoplastic elastomer is a radial styrene-butadiene block copolymer.

6. The process of claim 2 wherein said thermoplastic elastomer is a triblock styrene-diene block copolymer.

7. The process of claim 2 wherein said thermoplastic elastomer is a multiblock styrene-diene block copolymer.

8. The process of claim 2 wherein said thermoplastic elastomer is a graft styrene-diene block copolymer.

* * * * *